US007286779B2

(12) United States Patent
Kawagoe

(10) Patent No.: US 7,286,779 B2
(45) Date of Patent: Oct. 23, 2007

(54) APPARATUS FOR SUPPRESSING DEFORMATIONS IN A BELT OF AN IMAGE FORMING DEVICE

(75) Inventor: Katsuya Kawagoe, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 423 days.

(21) Appl. No.: 10/647,249

(22) Filed: Aug. 26, 2003

(65) Prior Publication Data

US 2004/0114951 A1 Jun. 17, 2004

(30) Foreign Application Priority Data

Sep. 18, 2002 (JP) ..... 2002-271704

(51) Int. Cl.
*G03G 15/00* (2006.01)

(52) U.S. Cl. ..... 399/66; 399/165

(58) Field of Classification Search ..... 399/66, 399/302, 303, 308, 312, 313, 165
See application file for complete search history.

(56) References Cited

U.S. PATENT DOCUMENTS

| | | | | |
|---|---|---|---|---|
| 4,429,985 | A | 2/1984 | Yokota | |
| 4,752,282 | A * | 6/1988 | Habegger | 474/283 |
| 5,084,735 | A | 1/1992 | Rimai et al. | |
| 5,313,254 | A * | 5/1994 | Temple | 399/78 |
| 5,442,428 | A | 8/1995 | Takahashi et al. | |
| 5,619,310 | A * | 4/1997 | Todome | 399/381 |
| 5,732,311 | A | 3/1998 | May et al. | |
| 5,807,651 | A | 9/1998 | Rimai et al. | |
| 5,890,030 | A | 3/1999 | Namekata et al. | |
| 5,983,060 | A | 11/1999 | Namekata et al. | |
| 6,044,243 | A * | 3/2000 | Hara | 399/302 |
| 6,101,360 | A | 8/2000 | Hara et al. | |
| 6,163,661 | A | 12/2000 | Namekata et al. | |
| 6,192,210 | B1 | 2/2001 | Munenori et al. | |
| 6,212,351 | B1 | 4/2001 | Kawagoe et al. | |
| 6,618,565 | B2 | 9/2003 | Tamiya et al. | |
| 6,810,228 | B2 * | 10/2004 | Kiuchi et al. | 399/307 |
| 6,835,520 | B2 * | 12/2004 | Bando et al. | 430/124 |
| 2004/0022557 | A1 * | 2/2004 | Kudo | 399/167 |

FOREIGN PATENT DOCUMENTS

| | | | |
|---|---|---|---|
| JP | 62050873 A | * | 3/1987 |
| JP | 04345457 A | * | 12/1992 |
| JP | 6-67480 | | 3/1994 |

(Continued)

OTHER PUBLICATIONS

Computer translation of Kawaguchi et al. (jp2002-251078a).*

(Continued)

*Primary Examiner*—Quana Grainger
(74) *Attorney, Agent, or Firm*—Oblon, Spivak, McClelland, Maier & Neustadt, P.C.

(57) ABSTRACT

A scale is provided on a back side edge of an intermediate transfer belt for detecting an amount of movement of the belt. In a tandem type image forming apparatus, a sensor is provided as a scale-reading unit that reads the scale. Materials used for the intermediate transfer belt and the scale satisfy a relation that the Young's modulus of the intermediate transfer belt is greater than the Young's modulus of the scale.

6 Claims, 13 Drawing Sheets

FOREIGN PATENT DOCUMENTS

| | | | | |
|---|---|---|---|---|
| JP | 8-63000 | | | 3/1996 |
| JP | 08211693 | A | * | 8/1996 |
| JP | 8-234531 | | | 9/1996 |
| JP | 09100043 | A | * | 4/1997 |
| JP | 11-24507 | | | 1/1999 |
| JP | 11024507 | A | * | 1/1999 |
| JP | 11-338175 | | | 12/1999 |
| JP | 2000289822 | A | * | 10/2000 |
| JP | 2001125333 | A | * | 5/2001 |
| JP | 2001194921 | A | * | 7/2001 |
| JP | 2001194922 | A | * | 7/2001 |
| JP | 2002-49246 | | | 2/2002 |
| JP | 2002091264 | A | * | 3/2002 |
| JP | 2002-131091 | | | 5/2002 |
| JP | 2002138265 | A | * | 5/2002 |
| JP | 2002145429 | A | * | 5/2002 |
| JP | 2002-251049 | | | 9/2002 |
| JP | 2002-251078 | | * | 9/2002 |
| JP | 2004177600 | A | * | 6/2004 |
| WO | WO 01/11432 | A1 | | 2/2001 |

OTHER PUBLICATIONS

U.S. Appl. No. 07/825,575, filed Jan. 24, 1992, Kawagoe et al.
U.S. Appl. No. 09/947,391, filed Sep. 7, 2001, Kawagoe et al.
U.S. Appl. No. 10/178,685, filed Jun. 25, 2002, Sugino et al.
U.S. Appl. No. 10/193,219, filed Jul. 12, 2002, Takahashi et al.
U.S. Appl. No. 10/214,595, filed Aug. 9, 2002, Sakamoto.
U.S. Appl. No. 10/246,623, filed Sep. 19, 2002, Kamiyama.
U.S. Appl. No. 10/282,039, filed Oct. 29, 2002, Ogiyama et al.
U.S. Appl. No. 10/373,050, filed Feb. 26, 2003, Yoshikawa et al.
U.S. Appl. No. 10/389,979, filed Mar. 18, 2003, Ogiyama et al.
U.S. Appl. No. 10/647,249, filed Aug. 26, 2003, Kawagoe.

* cited by examiner

APPARATUS FOR SUPPRESSING DEFORMATIONS IN A BELT OF AN IMAGE FORMING DEVICE

BACKGROUND OF THE INVENTION

1) Field of the Invention

The present invention relates to a technology for an image forming apparatus.

2) Description of the Related Art

In a conventional image forming apparatus, there are a couple of types of rotating belts, including an intermediate transfer belt used in an intermediate transfer system and a transfer sheet conveying belt used to support and carry the transfer sheet and let the transfer sheet pass through a transfer nip.

An example of an image forming apparatus that uses an intermediate transfer belt is, for instance, an image forming apparatus of a tandem type intermediate transfer system. The image forming apparatus of the tandem type intermediate transfer system includes a plurality of photosensitive drums, each of which has an individual developing device. A single color toner image is formed on each photosensitive drum and each color toner image is sequentially copied on to the intermediate transfer belt. Consequently, a combined color image is formed on the intermediate transfer belt, and the combined color image on the intermediate transfer belt is then batch-transferred on to the transfer sheet.

An example of an image forming apparatus that uses a transfer sheet conveying belt is, for instance, an image forming apparatus of a tandem type direct transfer system. The image forming apparatus of a tandem type direct transfer system includes a plurality of photosensitive drums, each of which has an individual developing device. A single color toner image is formed on each photosensitive drum, and each color toner image is sequentially superimposed on to a single transfer sheet, which is supported and carried by the transfer sheet conveying belt, and consequently a combined color image is formed on the transfer sheet.

The rotating belt (hereinafter, 'belt') is usually suspended by a plurality of rollers. A driving roller from among the rollers drives the belt in an endless movement.

Conventionally, a material is attached on one portion of the front or the back in the width direction of the belt for various purposes, such as a sheet used as a scale (hereinafter, 'scale') to detect and read an amount of movement of the belt by means of a sensor (see, for example, Japanese Patent Laid-Open Publication No. H11-24507) or a protection seal that is attached on both edges of the belt to prevent cracks being developed at the edges of the belt. At the time of driving the belt, in order to prevent biasing of the belt towards one end of the axis direction of a roller, a stopper is also attached in such a way that it protrudes within both edges of the belt. FIG. 13 is a schematic diagram of a belt V provided in an image forming apparatus. At both edges of the belt in the width direction, a material (hereinafter, 'affixed material S') is attached. When the belt V is driven in the image forming apparatus, it rotates in direction $\alpha$, as shown in FIG. 13.

In the image forming apparatus that employs the belt V, in which the affixed material S is attached to a portion on the front or the back of the belt, there is a chance to occur a problem as follows.

When the belt V continues to rotate, both edges of the belt in the width direction are about to bend inwards. FIG. 14 is a cross section of the belt cut along X in FIG. 13, illustrating that the edges of the belt are bent inwards. FIG. 15 is a magnified view of the end of the belt encircled in FIG. 14. As shown in FIG. 14, when the affixed material S is provided at both edges in the width direction on the inner surface of the belt, both ends of the belt bend towards the side of the affixed material S. If the belt V is suspended by a plurality of rollers and a tension is applied, a uniform tension is applied in the width direction in the belt V. However, an amount of stretch at the edges of the belt, where the affixed material S is provided, is smaller than an amount of stretch at the center part of the belt, where the affixed material S is not provided. Due to a difference in the amount of stretch, a peripheral length of the part where the amount of stretch is smaller and the affixed material S is provided is shorter than the peripheral length of the part where the amount of stretch is greater. As a result, as shown in FIG. 15, a deformation appears at a boundary d between the portion where the amount of stretch is smaller and the portion where the amount of stretch is greater, which causes both the edges of the belt to bend inwards.

Such a belt deformation in the image forming apparatus causes further problems.

In a structure in which a detecting mark is provided at one place of the inner surface of the belt and a sensor is provided at a position opposite to the detection mark, when the edges in the width direction of the belt bend inwards, the transit position of the detection mark gets shifted from the position opposite to the sensor. As a result, the detection timing goes off or the detection cannot be carried out.

When a belt suspended by a plurality of rollers is driven, in order to prevent biasing of the belt toward an edge side, a stopper is provided, which protrudes into the inner surface of both the edges in the width direction of the belt. In a belt in which the stopper is provided, when both the edges in the width direction bend inwards, instead of touching the ends of the roller, the stopper collide with the corners of the rollers or climb on to the side surfaces of the roller. This leads to a malfunction in the driving of the belt.

Moreover, the affixed material S is the scale for detecting the movement speed. When driving the belt, in a structure in which a sensor provided at a position opposite to the scale is used to carry out the belt movement speed detection, the following problem may arise. As shown in FIG. 16, as the angle of the scale becomes tilted with respect to a sensor 12, precision in the movement speed detection deteriorates and in some cases the detection cannot be carried out. In a structure in which various controls are carried out based on a result of the detection, malfunction occurs in those controls.

However, the tilt at the boundary d, which is caused due to the difference in the amount of stretch of the belt where the affixed material S is not provided and the part where the affixed material S is provided, is not necessarily confined to the edges in the width direction of the belt. For instance, when an affixed material is disposed along the center in the width direction of the belt, the stretch at the center of the belt is less while the stretch at both the edges is more, and the tilt occurs at the boundary. According to the deformation in the belt V, some unexpected malfunction may occur.

SUMMARY OF THE INVENTION

It is an object of the present invention to solve at least the problems in the conventional technology.

The image forming apparatus according to one aspect of the present invention includes a rotating belt for forming an image, the rotating belt having a Young's modulus, and an arrangement that is attached to a portion along the rotating belt, the material having a Young's modulus that is smaller than the Young's modulus of the rotating belt.

The image forming apparatus according to another aspect of the present invention includes a rotating belt for conveying a medium on which an image is directly transferred, the rotating belt having a Young's modulus, and an arrangement that is attached to a portion along the rotating belt, the material having a Young's modulus that is smaller than the Young's modulus of the rotating belt.

The other objects, features and advantages of the present invention are specifically set forth in or will become apparent from the following detailed descriptions of the invention when read in conjunction with the accompanying drawings.

DETAILED DESCRIPTION

Exemplary embodiments of an image forming apparatus according to the present invention are explained with reference to the accompanying drawings.

Figure 1:
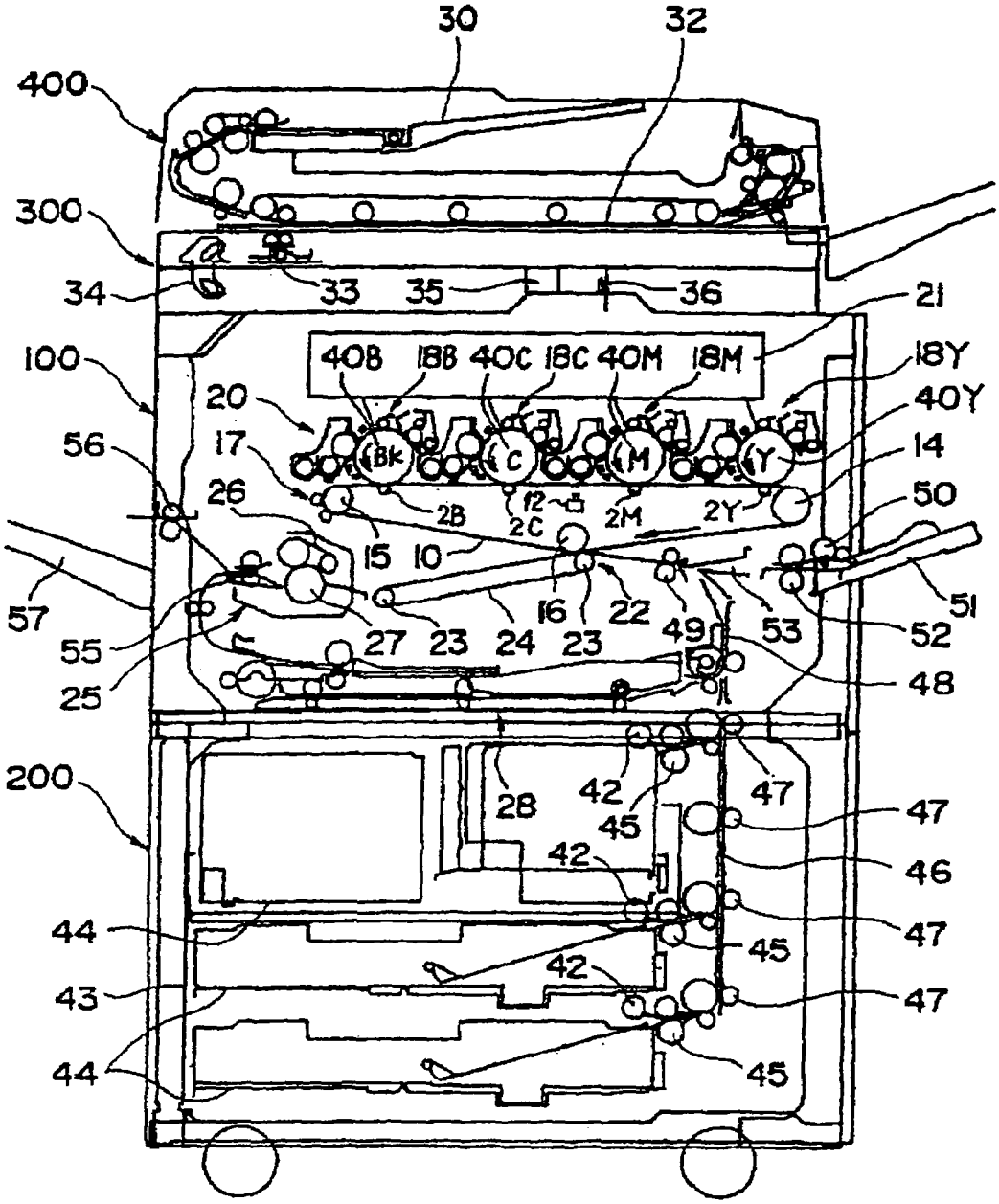
FIG. 1 is a schematic diagram of an image forming apparatus according to a first embodiment of the present invention.

An electronic color copying machine (hereinafter, 'color copying machine'), which is an image forming apparatus and an electronic photocopy machine, according to a first embodiment of the present invention is explained next. FIG. 1 is a schematic diagram the color copying machine according to the first embodiment. The color copying machine mainly comprises a main body 100, a paper feed table 200, a scanner 300, and an automatic document feeder (ADF) 400.

An intermediate transfer belt 10 as a rotating belt is provided centrally in the copying machine main body 100. The intermediate transfer belt 10 shown in FIG. 1 is driven in the clock-wise direction by three support rollers 14, 15, and 16. To the left of the second support roller 15, an intermediate transfer belt cleaning device 17 is provided that removes any residual toner remaining on the intermediate transfer belt 10 after image transfer is completed.

On the intermediate transfer belt 10 that is stretched across the first roller 14 and the second roller 15, four image forming units 18 of black, cyan, magenta, and yellow, are arranged horizontally along the conveying direction of the intermediate transfer belt 10. These parts comprise an image forming apparatus 20 (hereinafter, 'tandem image forming apparatus') of a tandem type that employs an intermediate transfer method. An exposing device 21 is provided above the tandem image forming apparatus 20.

A secondary transfer unit 22 is provided across the intermediate transfer belt 10 on the opposite side of the tandem image forming apparatus 20. The secondary-transfer unit 22 comprises an endless secondary transfer belt 24 which is stretched across two rollers 23. The secondary transfer unit 22 is disposed pressing the third support roller 16 via the intermediate transfer belt 10. The secondary transfer unit 22 transfers the image present on the intermediate transfer belt 10 on to a sheet.

A fixing device 25 that fixes the transfer image on to the sheet is provided beside the secondary transfer unit 22. The fixing device 25 comprises of a pressure roller 27 which is pressed against the endless fixing belt 26.

The secondary transfer unit 22 also includes a sheet conveying functionality that, after the image transfer is completed, conveys the sheet to the fixing device 25. A non-contact charger may be provided as the secondary transfer unit 22. However, in such a case, it is difficult to provide in conjunction the sheet conveying functionality.

Below the secondary transfer unit 22 and fixing device 25 and parallel to the tandem image forming apparatus 20, a sheet reversing device 28 is provided that reverses the sheet so that the image can be copied on both sides of the sheet.

When copying operation is carried out using the color copying machine, the original document to be copied is first set on a sheet paper tray 30 of the automatic document feeder 400. Alternatively, the automatic document feeder 400 is opened, the original document is set on a contact glass 32 of the scanner 30, and the automatic document feeder 400 is closed in order to press the original document.

When a not shown start switch is pressed, if the original document is set in the automatic document feeder 400, it is conveyed to the contact glass 32 and then the scanner is driven, and if the original document is set on the contact glass 32, the scanner is immediately driven and a first driver 33 and a second driver 34 are run. A light source in the first driver 33 emits a light beam as well as reflects to the second driver 34 the reflected light from the surface of the original document. A mirror in the second driver 34 reflects the reflected light and inputs it into a reading sensor 36 via an imaging lens 35. In this way, the contents of the original document are read.

On pressing the start switch, one of the support rollers 14, 15, and 16 is rotation-driven first by a not shown driving motor and the remaining two support rollers are subsequently rotation-driven, the three support rollers 14, 15, and 16 eventually driving the intermediate transfer belt 10. At the same time, in each of the four image forming units 18, respective photosensitive drums 40 are rotated and a single color image of black, yellow, magenta, and cyan is respectively formed on the each of the photosensitive drums 40. When the intermediate transfer belt 10 is conveyed, the single color images are sequentially transferred on to the intermediate transfer belt 10 and a composite color image is formed on the intermediate transfer belt 10.

Meanwhile, upon pressing the start switch, one of the paper feed rollers 42 of the paper feed table 200 is selected and rotated. Sheets provided in one of the feed cassettes 44 disposed at multiple levels in a paper bank 43 are then separated in a separating roller 45 and are singly fed to a paper feed channel 46. The single sheet is conveyed by a conveying roller 47 and forwarded to an internal paper feed channel 48 provided inside the copying machine main body 100, and is held in position when the paper comes in contact with a resist roller 49.

Alternatively, a paper feed roller 50 is rotated, the sheets on a tray 51 are manually fed, each sheet is separated in a separating roller 52 and manually fed to a paper feed channel 53. The sheet is held in position when it comes in contact with the resist roller 49.

The resist roller 49 is rotated in synchronization with the composite color image on the intermediate transfer belt 10. The sheet is then fed between the intermediate transfer belt 10 and the secondary transfer unit 22. The composite color image is transferred on to the sheet by the secondary transfer unit 22 and a copy of the color image obtained on the sheet.

The sheet on which the image is transferred is conveyed by the secondary transfer unit 22 to the fixing device 25. The fixing device 25 fixes the transferred image by applying heat and pressure. The sheet is switched in a switching nail 55, ejected by an ejection roller 56, and stacked on an ejection tray 57. Alternatively, the sheet is switch in the switching nail 55 and fed to the sheet reversing device 28. The sheet reversing device 28 reverses the sheet and again forwards it to the transferring position. The sheet is ejected to the ejection tray 57 by the ejection roller 56 after the image is printed on the back of the sheet as well.

After the image transfer is completed, the intermediate transfer belt cleaning device 17 cleans the residual toner remaining on the intermediate transfer belt 10. The intermediate transfer belt 10 thus again prepares for the image forming to be carried out by the tandem image forming apparatus 20.

The color copying machine according to present embodiment has a structure that detects the amount of movement of the intermediate transfer belt 10.

Figure 2:
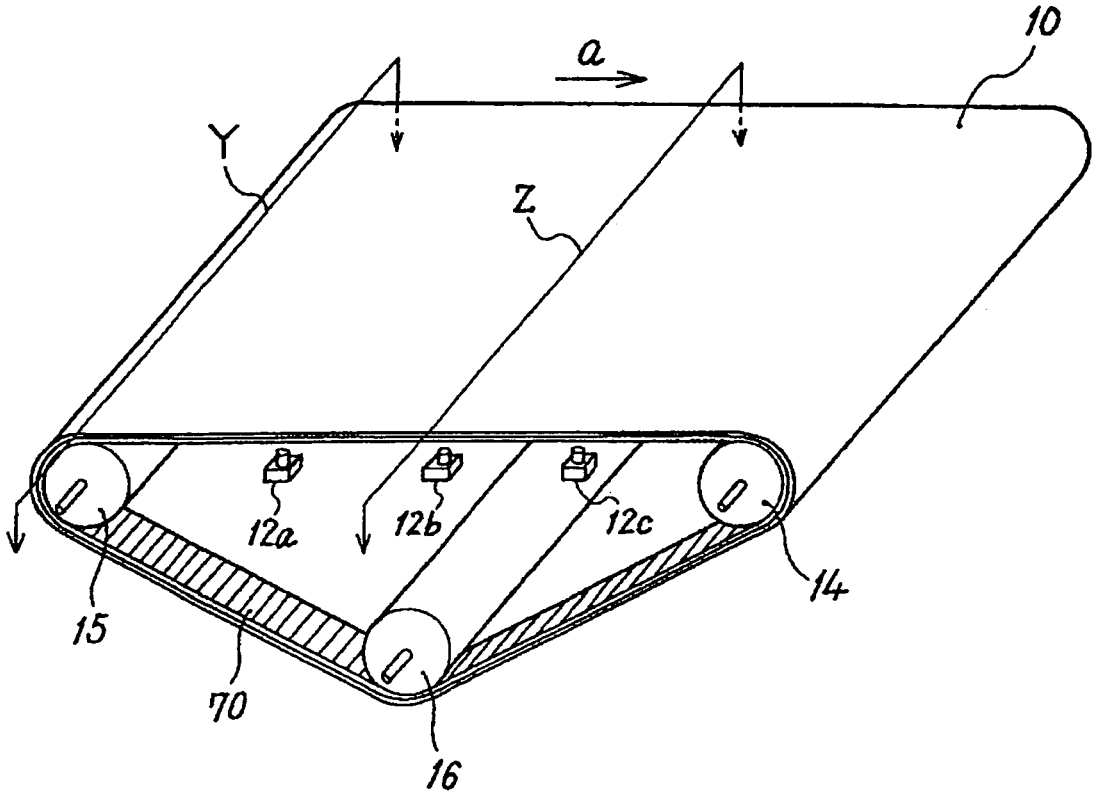
FIG. 2 is a schematic diagram of a scale, which is used to detect an amount of movement, provided inside an intermediate transfer belt.
Figure 3:
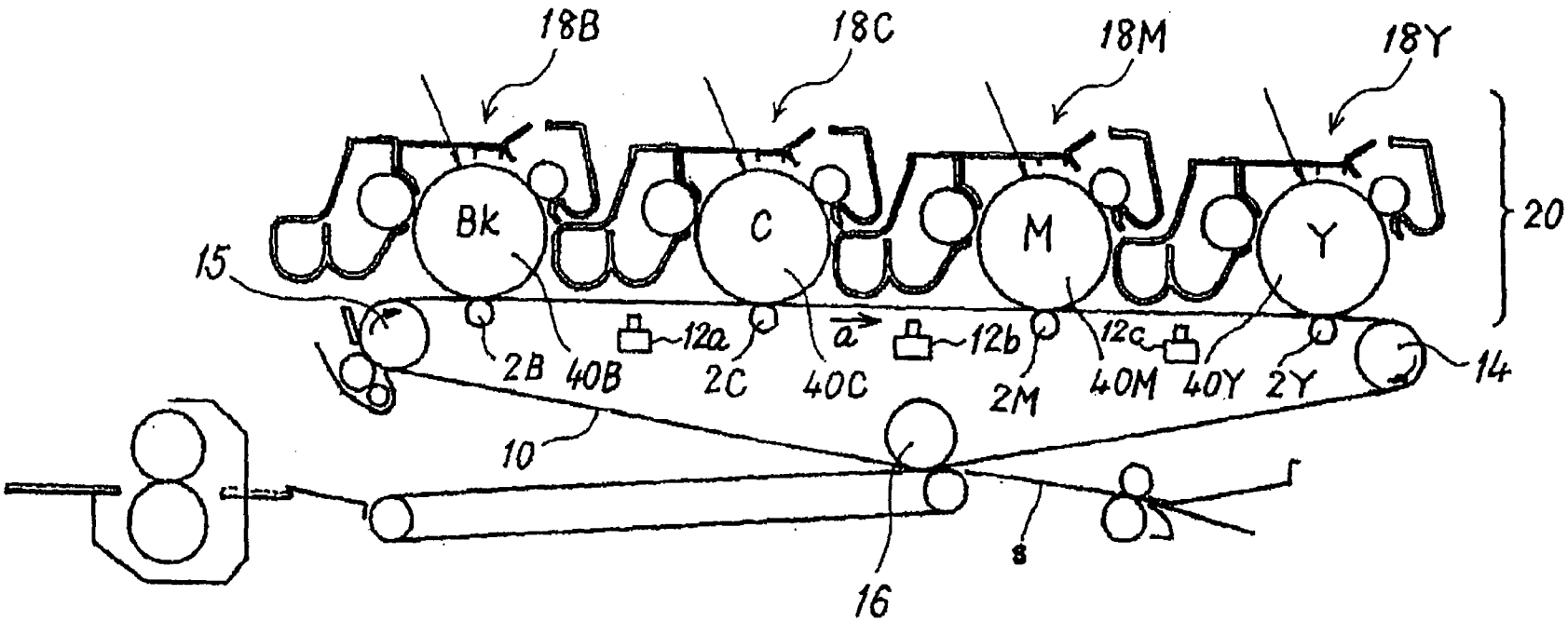
FIG. 3 is a magnified view of a part of a tandem type image forming apparatus, in which a sensor is provided as a scale-reading unit.

FIG. 2 is a schematic diagram of a scale, which is used to detect an amount of movement in the intermediate transfer belt 10. FIG. 3 is a magnified view of a part of a tandem type image forming apparatus 20 in which sensors 12A, 12B, and 12C are provided as scale-reading units that read the scale 70 provided in the intermediate transfer belt 10. As shown in FIG. 2, the scale 70 is attached along the circumference of the inside perimeter of the intermediate transfer belt 10 on the edge in the width direction. The sensors 12A, 12B, and 12C are placed at a specific distance from the scale 70 between the support roller 14 and the support roller 15 roughly midway between two successive transfer positions. As the scale 70 is provided on the inside perimeter of the intermediate transfer belt 10, the sensors 12A, 12B, and 12C that read the scale 70 can be provided inside the intermediate transfer belt 10 in a comparatively uncluttered place that does not affect the layout of other components. Moreover, the scale 70 is provided at the edge of the intermediate transfer belt 10, that is, on the back of the intermediate transfer belt 10, which is outside the image forming area. As a result, unexpected effects caused due to providing the scale 70 in the image can be avoided.

Figure 4:
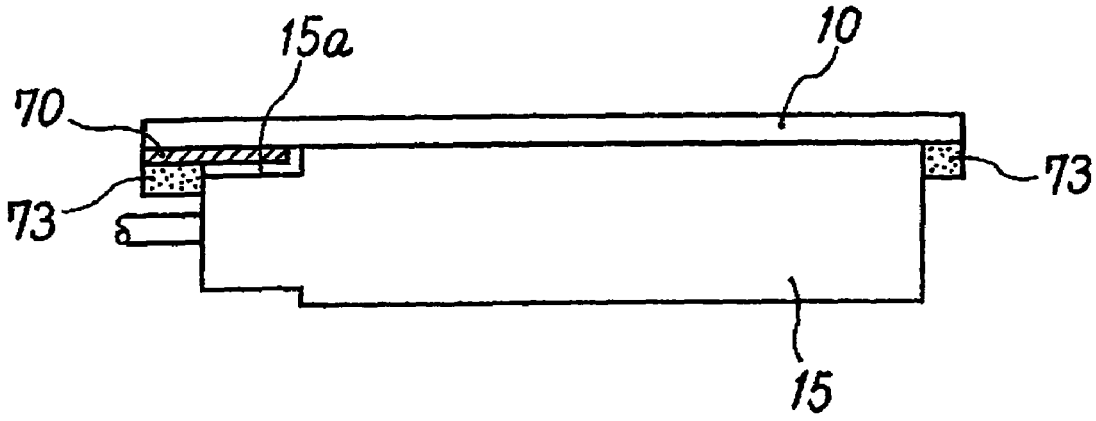
FIG. 4 is a cross-section of the intermediate transfer belt cut in Y direction shown in FIG. 2.

In order to prevent the titling of the intermediate transfer belt 10 towards the direction of the axis of rotation of the support rollers 14, 15, and 16, a stopper 73 is attached to the edge of the intermediate transfer belt. The support rollers 14, 15, and 16 rotate inside the stopper 73. FIG. 4 is a cross-section of the intermediate transfer belt cut in Y direction shown in FIG. 2. As shown in FIG. 4, when the intermediate transfer belt 10 is rotating, in order to prevent the damage caused by the scale 70 touching the front of the support rollers 14, 15, and 16, a roller recess 15*a* of *c*, which is greater than the thickness of the scale 70, is provided at the ends of the support rollers 14, 15, and 16.

The scale 70 and the sensors 12A, 12B, and 12C may be an optically readable system or of a magnetically readable system. The present embodiment includes the scale 70 that is fabricated by placing alternately in the rotation direction a light reflective surface and a non-reflecting surface of a minute and accurate pitch on a plastic sheet, and optical sensors that emit a convergent beam to the scale 70 and read the reflected light from the reflexive surface of the scale 70.

Figure 5A:
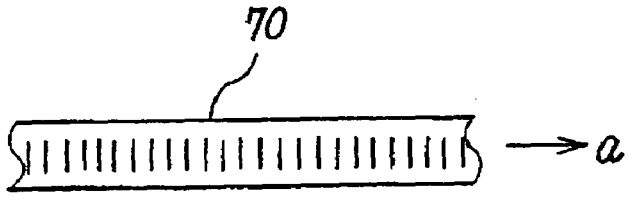
FIG. 5A and FIG. 5B illustrates an example of the structure of the scale.
Figure 5B:
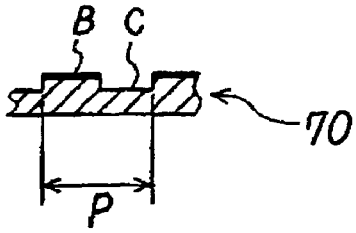

The scale 70 according to the present-embodiment is an optically readable scale and is fabricated by placing alternately in the driver direction a light reflective surface B and a non-reflective surface C of a minute and accurate pitch on a plastic sheet. The light reflective surface B and the non-reflective surface C can be fabricated, for instance, by depositing on the plastic sheet a material such as aluminum or nickel, etc., that has high reflectance and then selectively removing, by means of a laser beam such as an exciter laser, etc., the deposited material from the surface that is to be made non-reflective. In the structure of the scale 70 shown in FIG. 5A and FIG. 5B, a pitch P, which is formed from a pair of the reflective surface B and the non-reflective surface C in the conveying direction (along direction a in FIG. 15A) of the intermediate transfer belt 10, is set in the range of 10 μm to 20 μm, and the width of the reflective surface B is set to half of the pitch P.

Figure 6:
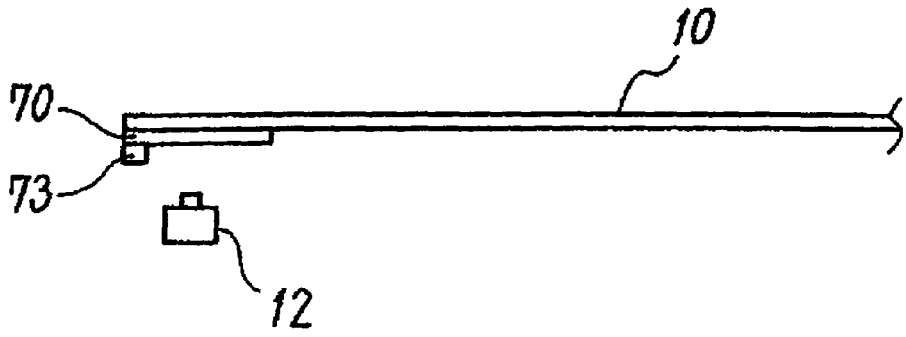
FIG. 6 illustrates an ideal position relation between the sensor and the scale.

FIG. 6 illustrates an ideal position relation between the scale 70 and a sensor 12 when the sensor 12 reads the scale 70. As shown in FIG. 6, the sensor 12 reads the scale 70 provided in the intermediate transfer belt 10 and detects the amount of movement of the intermediate transfer belt 10. Consequently, the rotation position and the amount of movement of the intermediate transfer belt 10 can be directly as well as precisely detected. In other words, the amount of movement (rotation position), which includes the expansion and contraction of the intermediate transfer belt 10 or the effect due to the minute difference in the speed of the photosensitive drum, etc., of the intermediate transfer belt 10 can be precisely detected. The movement speed of the intermediate transfer belt 10 can also be precisely detected.

However, in the structure described above, there were times when error occurred in the detection result of the amount of movement of the intermediate transfer belt 10. When the inventors studied the cause, it became evident that the position relation between the sensor 12 and the scale 70 was the ideal relation that is shown in FIG. 6, directly causing the problem.

Figure 15:
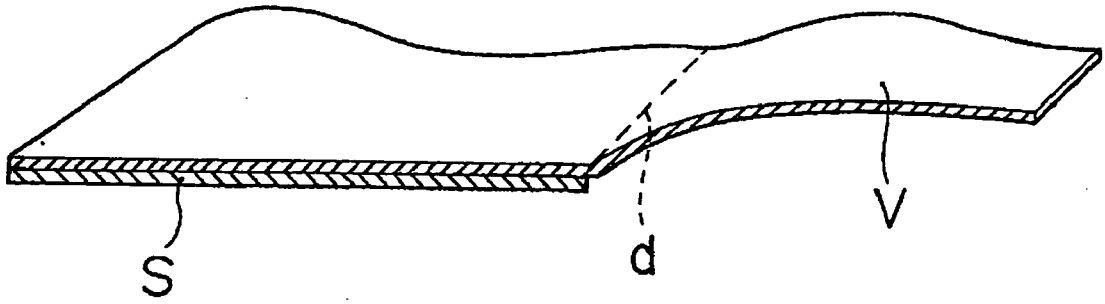
FIG. 15 is a magnified view of one edge of the intermediate transfer belt encircled in FIG. 14.
Figure 16:
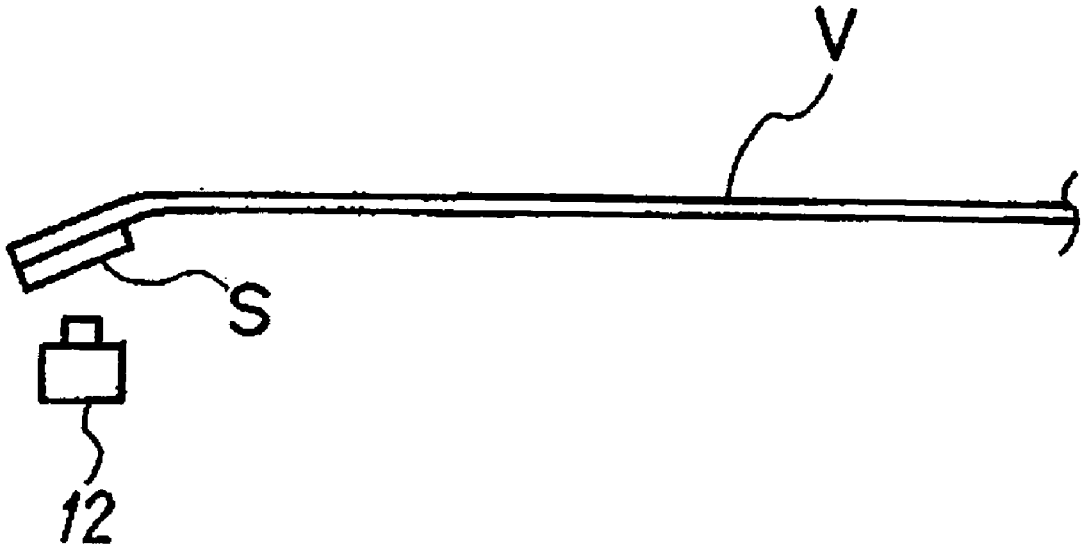
FIG. 16 illustrates a problematic case in which a scale angle is tilted with respect to a sensor.

After attaching the scale 70 or the stopper 73 to the intermediate transfer belt 10, it is necessary to apply tension to the intermediate transfer belt 10 by means of the support rollers 13, 14, and 16. If, in this condition, the Young's modulus of the intermediate transfer belt 10 is less than the Young's modulus of the scale 70, due to the reinforcing effect of the scale 70, the stretching of the edge of the intermediate transfer belt 10 where the scale 70 is present is less as compared to the portion of the intermediate transfer belt where the scale is absent. Hence, as shown in FIG. 15, a tilt occurs at the joint between the scale 70 and the intermediate transfer belt 10. As a result, as shown in FIG. 16, the angle of the scale 70 tilts with respect to the sensor 12, precision of the movement speed detection deteriorates, and error occurs in the detection result. When a severe deformation of the intermediate transfer belt 10 occurs, it may not even be possible to carry out the speed detection.

Therefore, in the first embodiment of the present invention, materials used in the intermediate transfer belt 10 and the scale 70 are such that they satisfy the relation that the Young's modulus of the intermediate transfer belt 10 is greater than the Young's modulus of the scale 70.

When a polyimide is used as the material for the intermediate transfer belt 10 and the material described above is used as the material for the scale 70, the Young's modulus of the intermediate transfer belt 10 is in the range of 3000 megapascals to 7000 megapascals, while the Young's modulus of the scale 70 is in the range of 300 megapascals to 800 megapascals. In the present embodiment, the Young's modulus of the material used for the intermediate transfer belt 10 is 700 megapascals and the Young's modulus of the material used for the scale 70 is 550 megapascals.

In this way, if the Young's modulus of the intermediate transfer belt 10 is maintained higher than the Young's modulus of the scale 70, or conversely, if the Young's modulus of the scale 70 is maintained lower than the Young's modulus of the intermediate transfer belt 10, even when the tension is applied to the intermediate transfer belt 10, the scale 70 will also stretch in accordance with the stretching of the intermediate transfer belt 10. Consequently, the bending inward of the edge of the belt, which is caused when only the central part of the belt stretches and the edge of the belt does not stretch. Hence, unlike as shown in FIG. 6, the angle of the scale 70 does not tilt with respect to the sensor 12. Further, the scale 70 may contract when attached to the intermediate transfer belt 10 due to fluctuation in temperatures. This may result in waviness in the intermediate transfer belt 10. However, if the Young's modulus of the intermediate transfer belt 10 is maintained higher than the Young's modulus of the scale 70, as in the present embodiment, the intermediate transfer belt 10 does not get deformed due to the contraction of the scale 70 and hence the waviness of the belt can also be prevented.

When the Young's modulus of the intermediate transfer belt 10 is less, the amount of stretch of the belt due to the tension applied to the intermediate transfer belt 10 increases and the scale 70 also stretches along with the belt. The precision of the speed detection of the sensor 12 can be guaranteed as long as the amount of stretch of the scale 70 is constant. However, as there is fluctuation in the Young's modulus of the belt, the amount of stretch of the scale 70 also varies. It is a proven fact that when the amount of stretch of the scale 70 varies to a great extent, the fluctuation in the detected speed of the intermediate transfer belt 10 would be to such an extent that it would yield a bad quality image.

According to the present embodiment, if the tension applied to the intermediate transfer belt 10 is taken as T [N/mm2], the maximum length of the image formed as L [millimeter], the Young's modulus of the intermediate transfer belt 10 as E [megapascal], and a fluctuation in the Young's module as $\alpha$, a following relation is satisfied.

$$T/E \times L \times \alpha \leqq 0.03 \text{ [millimeter]}.$$

If we assume that the tension T applied to the intermediate transfer belt 10 is 1 N/mm$^2$, the maximum length of an A3 size image is 420 millimeters, the fluctuation in the Young's modulus is about 10 percent, that is, the fluctuation $\alpha$ in the Young's modulus is 0.1, and as described above, the Young's modulus of the intermediate transfer belt 10 is 7000 megapascals and substitute these values in the relation shown above, the result is 0.006 millimeters. This means that when transferring the A3 size image on to the intermediate transfer belt, the maximum fluctuation in the distance from the front-end to the back-end of the image is about 0.006 millimeters. When transferring plural images on to the intermediate transfer belt 10, the maximum color shift on the images is about 0.006 millimeters. Usually the color shift becomes visually recognizable when it exceeds 0.03 millimeters. According to the present embodiment, as the color shift is only 0.006 millimeters, the color shift is not discernible.

According to the present embodiment, the intermediate transfer belt 10 that has a Young's modulus of 7000 megapascals was used. However, the Young's modulus of the intermediate transfer belt 10 need not necessarily be confined to this value. As described above, when the tension T is 1 N/mm$^2$, the maximum image length L is 420 millimeters, and the fluctuation in the Young's modulus is 10 percent, the color shift, which will be not greater than 0.03 millimeters, will not pose any problem as long as the Young's modulus of the intermediate transfer belt 10 is not less than 1400 megapascals. However, it is more preferable to have a Young's modulus of not less than 3000 megapascals. As the Young's modulus of the intermediate transfer belt 10 used in the present embodiment varies in the range of 3000 megapascals to 7000 megapascals according to the material, there is no possibility of occurrence of color shift. The range of the Young's modulus of the intermediate transfer belt 10 also varies according to the tension T applied, the maximum length L of the image formed, and the fluctuation in the Young's modulus $\alpha$, etc. Whatever the case, it is preferable to choose these settings in order that the color shift on the image is never greater than 0.03 millimeters.

Figure 7A:
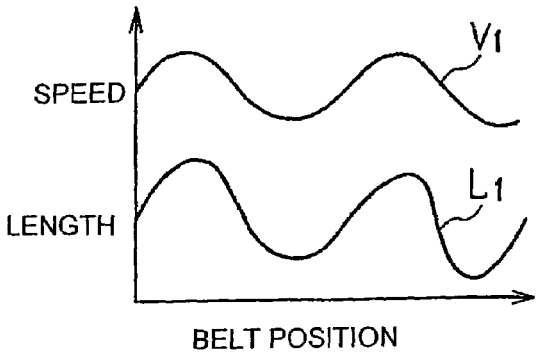
FIG. 7A and FIG. 7B illustrate a relation between a movement speed of the belt and a fluctuation of a travel length of the belt, comparing a conventional intermediate transfer belt and the intermediate transfer belt according to the present invention, respectively.
Figure 7B:
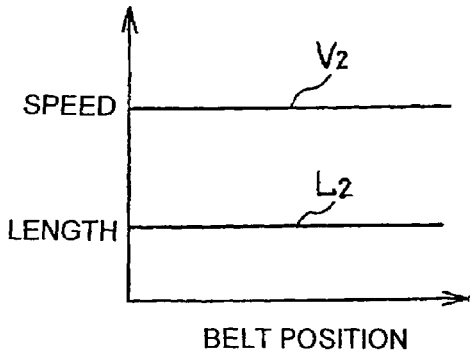
Figure 8:
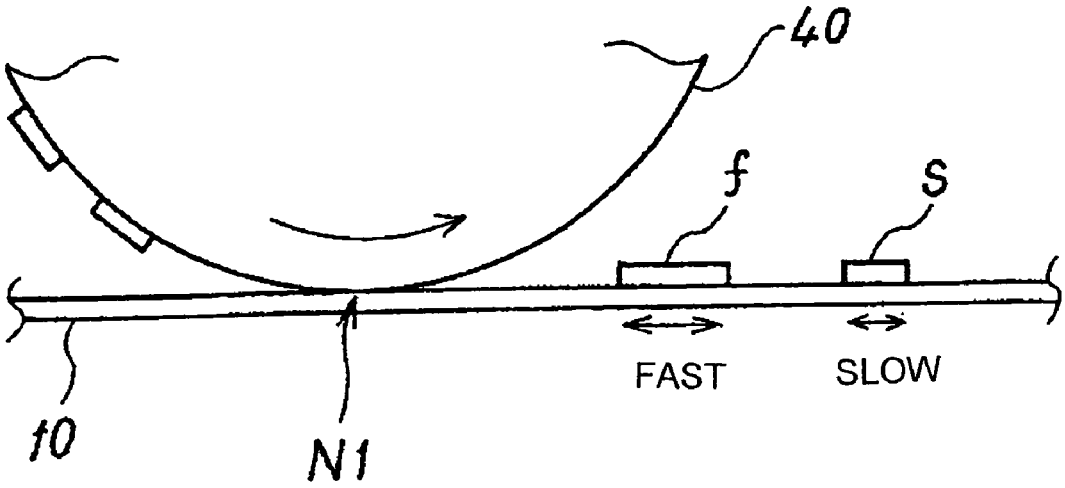
FIG. 8 is a magnified view of a part of a primary transfer nip.

In the conventional technology, when the movement speed varies, the length of the image copied on to the intermediate transfer belt 10 varies. FIG. 7A and FIG. 7B illustrate a relation between a movement speed of the belt 10 and a fluctuation of a travel length of the belt, comparing a conventional intermediate transfer belt 10 and the intermediate transfer belt according to the present invention, respectively. FIG. 8 is a magnified view of a part of a primary transfer nip by which the image is copied on to the intermediate transfer belt 10. As shown in FIG. 8, if the movement speed of the intermediate transfer belt 10 varies while the photosensitive drum that is driven at a constant speed, then at a primary transfer nip N1, the length of the intermediate transfer belt 10 that is facing towards the image of the same length on the photosensitive drum differs. When the speed of the intermediate transfer belt 10 is slow at the primary transfer nip N1, the image on the intermediate transfer belt 10 contracts (indicated by a reference symbol s in FIG. 8) and when the speed of the intermediate transfer belt 10 is fast, the image on the intermediate transfer belt 10 stretches (indicated by reference symbol f in FIG. 8). FIG. 7A illustrates this relation between the speed and the length.

In FIG. 7A, the horizontal axis represents the position of the intermediate transfer belt 10 at the primary transfer nip, and the vertical axis represents the movement speed of the intermediate transfer belt 10 and the length of the primary transfer image. As shown by V1 in FIG. 7A, in the conventional technology, the detected movement speed of the intermediate transfer belt 10 used to vary, becoming faster or slower. According to the fluctuation in the speed, the length L1 of the image copied on the intermediate transfer belt 10 also used to increase or decrease.

If a feedback is sent to the driver in order to keep the belt speed constant, the stretching or contraction of the image does not occur and a good image with a constant scale can be obtained.

In a color copying machine according to the first embodiment of the present invention, a feedback control system is included in order to carry out a precise feedback control of the run position and the run speed of the intermediate transfer belt 10. This feedback control system comprises a position detecting circuit 77 that converts to a position signal the signal from the sensor 12, which reads the scale 70 bearing microscopic calibration, and a speed detecting circuit 78 that converts to a speed signal the signal from the sensor 12. The feedback control system forms minor loops that negative-feedback each signal, each position signal, and each speed signal.

Figure 9:
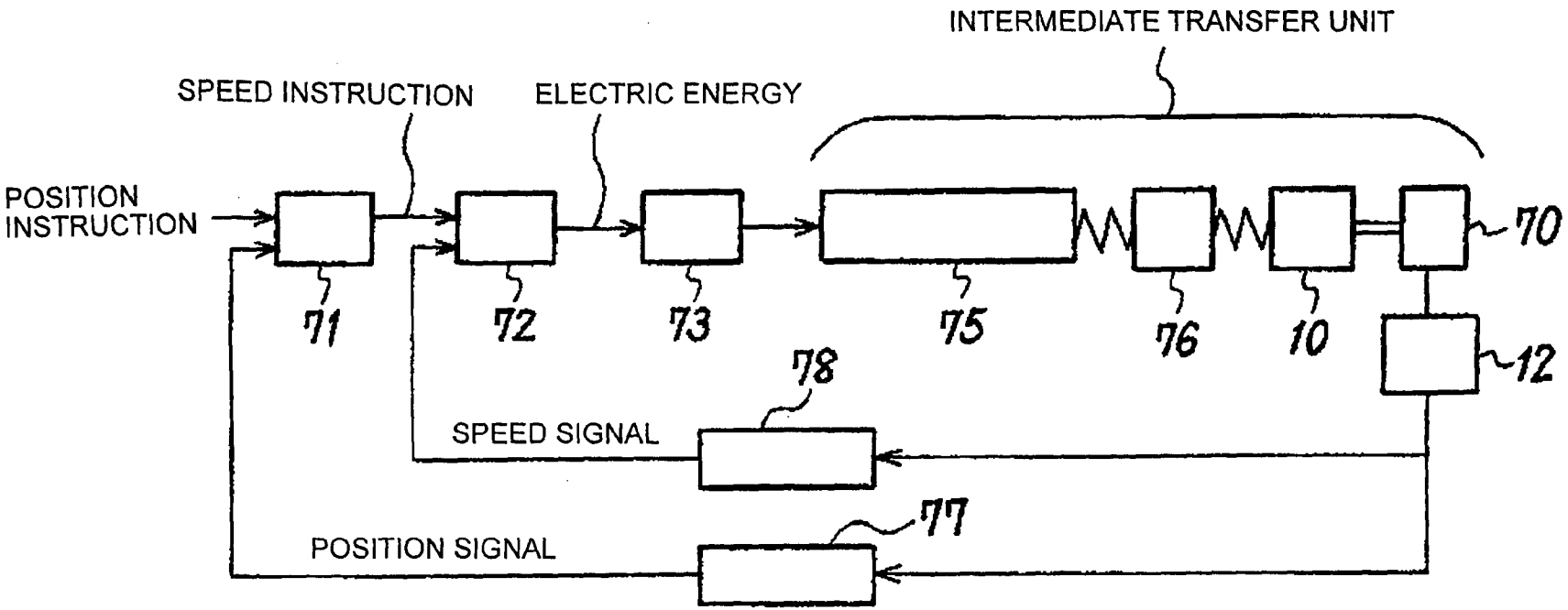
FIG. 9 is a block diagram of a feedback control of the intermediate transfer belt.

In the feedback control system shown in FIG. 9, the structure of an intermediate transfer unit, which is to be controlled, is divided into four blocks, namely, a driving motor unit 75, a mechanical unit 76, the intermediate transfer belt 10, and the scale 70, and represents a model connected according to the substitution principles of the feedback control. The driving motor unit 75 comprises a not shown driving motor and an axis of rotation, etc., and rotates uniformly. The mechanical unit 76 is fabricated from the three support rollers 14, 15, and 16, and coupled with the intermediate transfer belt 10 because of the friction, and transmits the rotation to the driving motor unit 75.

The intermediate transfer belt 10 and the scale 70 constitute one unit and the unit rotates according to the friction with the mechanical unit 76. Consequently, in the rotation movement of the intermediate transfer belt 10 and the scale 70, the fluctuation in the speed of the driving motor as well as the rolling of the three support rollers 14, 15, and 16, because of the friction, are propagated to the intermediate transfer belt 10 and the scale 70 bearing microscopic calibration. Consequently, the sensor 12 can precisely detect the amount of movement (rotation position) of the intermediate transfer belt 10. In other words, the position signals and the speed signals, which are obtained by calculating from the output of the sensor 12, are the precise result of the detection directly carried out for the intermediate transfer belt 10. As the precise detection result of the amount of movement (rotation position) of the intermediate transfer belt 10 can be obtained, the correction in the write timing can also be precisely carried out.

A position control circuit 71 calculates the difference between the precise and minute position signals from the position detecting circuit 77 and a position instruction (target position), and can precisely calculate and output a speed instruction (target speed). A speed control circuit 72 calculates the difference between the precise speed instruction (target speed) from the position control circuit 71 and the speed signals from the speed detecting circuit 78. The speed control circuit 72 then calculates the precise electrical energy supplied to the not shown driving motor and outputs it to an electric power converting circuit 73, and controls the driving motor. Consequently, it is possible to precisely and minutely feedback-control the amount of movement (rotation position) of the intermediate transfer belt 10.

The feedback control system shown in FIG. 9 can be fabricated from an analog circuit or a digital circuit. Electronic components that are easily available in the market and carry out high speed, high precision, and highly reliable operations can be used as the position detecting circuit 77, the speed detecting circuit 78, the position control circuit 71, and the speed control circuit 72. For instance, an operational amplifier, a counter, an analog to digital converter, a digital to analog converter, etc., can be used in the structure. The electric power converting circuit 73 can be fabricated from commonly used transistors such a bipolar transistor (silicon, etc.), a field effect transistor, etc.

As shown in FIG. 3, the speed control of the intermediate transfer belt 10 is carried out based on the average value of the speeds detected by the three sensors 12A, 12B, and 12C. Consequently, it is possible to maintain the belt speed more constantly at each transfer position. FIG. 7B illustrates the length of the image in such a case. As shown by V2 in FIG. 7B, the movement speed of the intermediate transfer belt 10 becomes constant by drive controlling the intermediate transfer belt 10. When the speed of the intermediate transfer belt 10 is maintained constant, the length L2 of the image copied on the intermediate transfer belt 10 also becomes constant.

In the present embodiment, three sensors—12A, 12B, and 12C—are provided. However, it is possible to reduce the number of sensors to one or two. When only one sensor is provided, the speed control of the intermediate transfer belt 10 is carried out based on the result of the detection by that sensor.

Figure 10A:
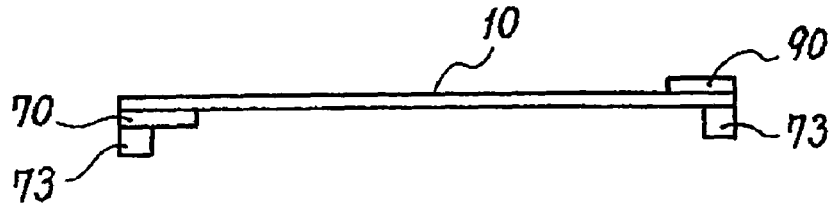
FIG. 10A to FIG. 10C are cross sections of the intermediate transfer belt as modifications of the first embodiment of the present invention, cut in a Z direction shown in FIG. 2.
Figure 10B:
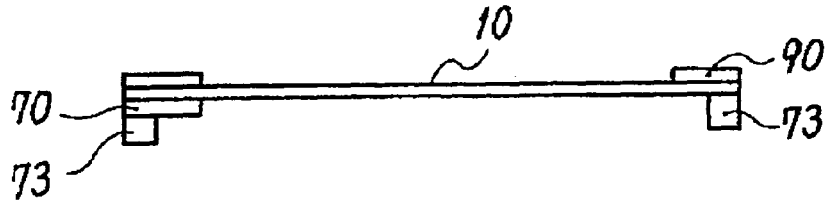
Figure 10C:
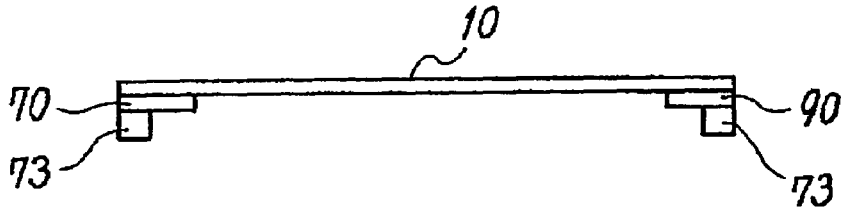

FIG. 10A to FIGS. 10C 10A to FIG. 10C are cross sections of the intermediate transfer belt as modifications of the first embodiment of the present invention, cut in a Z direction shown in FIG. 2. The intermediate transfer belt 10 is provided with a protection seal as the affixed material in order to protect the edges of the intermediate transfer belt 10. The scale 70 and the stopper 73 are also provided. A protection seal 90 is fabricated from polyethylene terephthalate and is affixed in order to prevent cracks, etc., at the edges of the intermediate transfer belt 10.

As shown in FIG. 10A, the protection seal 90 may be provided on the outer surface on the edge of the intermediate transfer belt 10 where the scale 70 is not provided. The protection seal 90 may be located elsewhere on the intermediate transfer belt 10, such as on the outer surface on both the edges of the intermediate transfer belt 10 as shown in FIG. 10B, or on the inner surface on the edge of the intermediate transfer belt 10 where the scale 70 is not provided. The protection seal 90 may be provided at several other locations and is not necessarily confined to the positions shown in FIG. 10A to FIG. 10C.

In the present embodiment, the Young's modulus of the intermediate transfer belt 10 and the Young's modulus of the protection seal 90 satisfy the relation that the Young's modulus of the intermediate transfer belt 10 is greater than the Young's modulus of the protection seal As the material described above is used as the material for the protection seal, the Young's modulus of the protection seal is in the range of 300 megapascals to 800 megapascals. In the present embodiment, the Young's modulus of the protection seal is set to 550 megapascals, that is, the same as that of the scale 70.

In the present embodiment, the Young's modulus of the intermediate transfer belt 10 and the Young's modulus of the stopper 73 satisfy the relation that the Young's modulus of the intermediate transfer belt 10 is greater than the Young's modulus of the stopper 73

In the present embodiment, the material for the stopper has an integrated structure of urethane rubber and polyethylene terephthalate that is provided inside the polyurethane rubber. The Young's modulus of the stopper is set to 550 megapascals, that is, the same as that of the scale 70. As the stopper has a thickness of about 1 millimeter, which is more than the thickness of the scale 70, etc, a polyurethane rubber of low Young's modulus may also be used. Such a stopper has a suitable Young's modulus in the range of 2 megapascals to 10 megapascals. However, the stopper that is composed of polyurethane rubber and polyethylene terephthalate, as in the present embodiment, is stronger.

Figure 11:
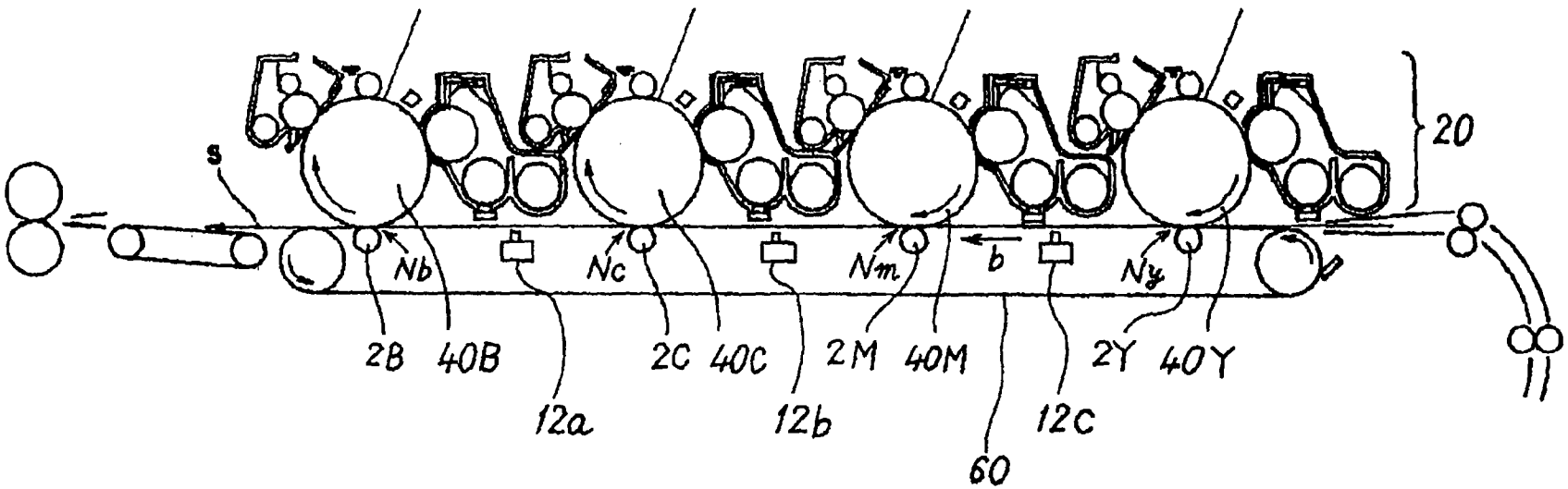
FIG. 11 is a schematic diagram of an image processing apparatus of a tandem type direct transfer system according to a second embodiment of the present invention.

A second embodiment of the present invention is explained next. In the first embodiment, the present invention was applied to the intermediate transfer belt 10 provided in a color copying machine of a tandem type indirect transfer system. However, it is also possible to apply the present invention to a sheet conveying belt 60 (FIG. 11) used as a transfer sheet conveying belt in a color copying machine of a tandem type direct transfer system. FIG. 11 is a schematic diagram of an image processing apparatus 20 of a tandem type direct transfer system, and the sheet conveying belt 60 and parts in its vicinity.

A sheet S is in tight contact with the sheet conveying belt 60 and carried along direction b shown in FIG. 11. By means of four image transfer devices 2Y, 2M, 2C, and 2B, each toner image is directly transferred on to the sheet S at the respective transfer nips Ny, Nm, Nc, and Nb.

In the sheet conveying belt 60 also, a scale 70 is provided at the edge in the width direction, similar to that of the intermediate transfer belt 10 in the first embodiment of the present invention. The Young's modulus of the scale 70 is less that than the Young's modulus of the sheet conveying belt 60. Sensors 12A, 12B, and 12C for speed detection are provided at positions that are roughly midway between two successive transfer positions and the movement speed of the sheet conveying belt 60 can be detected.

In the second embodiment of the present invention, based on the result of the movement speed detection of the sheet conveying belt 60, the start timing of the image formation by the image forming apparatus 20 is feedback-controlled.

Figure 12:
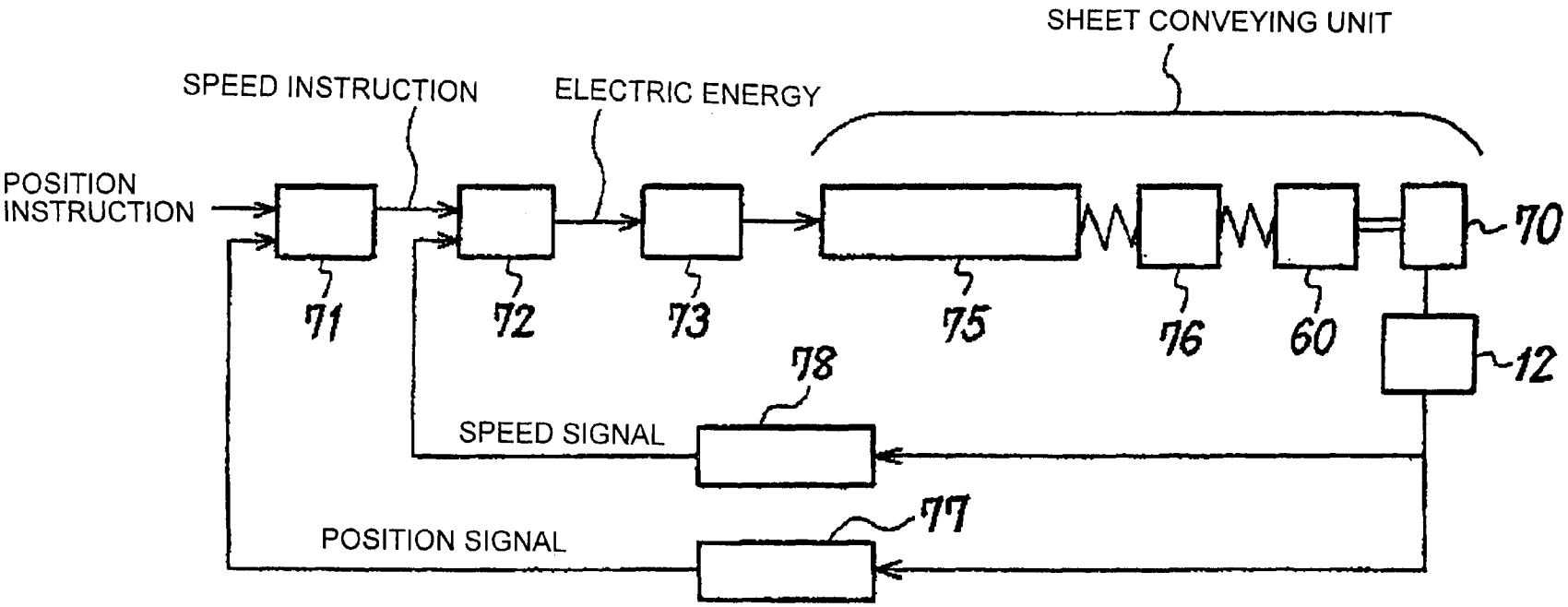
FIG. 12 is a block diagram of a feedback control of a transfer sheet conveying belt.
Figure 13:
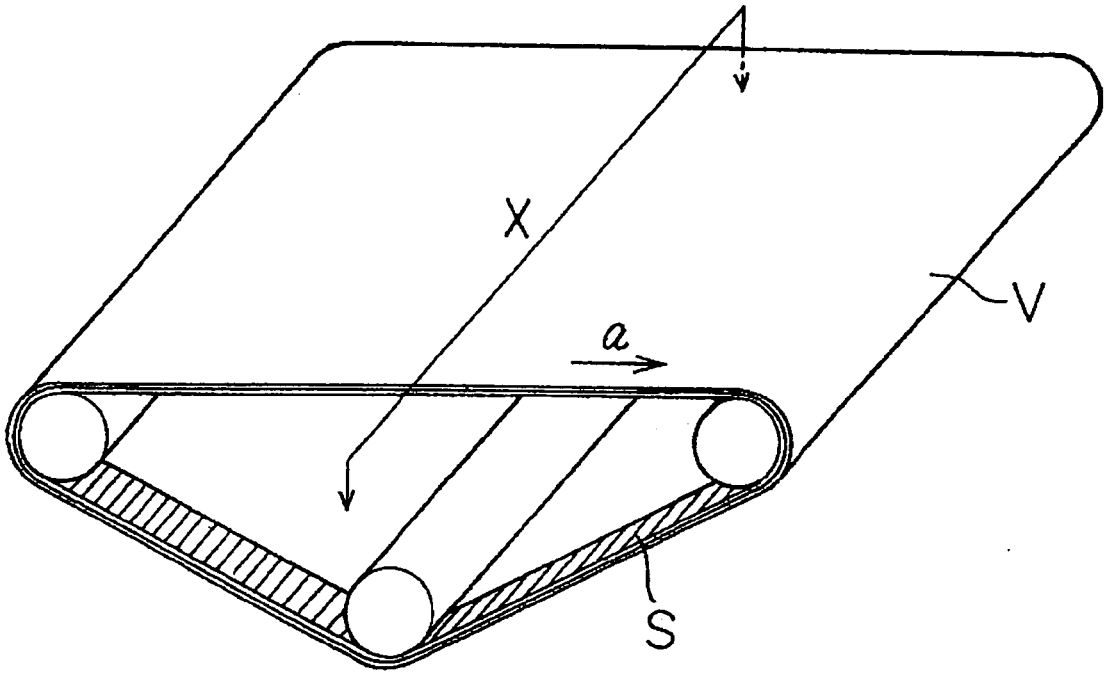
FIG. 13 is a schematic diagram of a conventional intermediate transfer belt.
Figure 14:
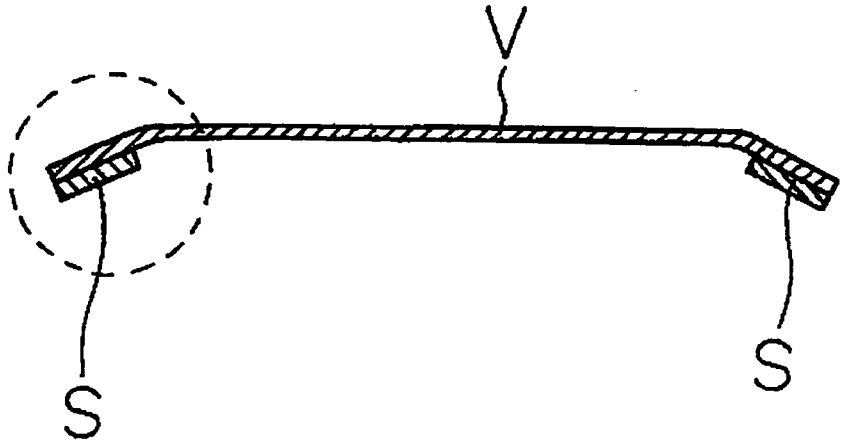
FIG. 14 illustrates a conventional problem in which both edges of an intermediate transfer belt are bent inwards.

In the color copying machine according to the second embodiment of the present invention, a feedback control system shown in FIG. 12 is included in order to carry out a precise feedback control of the run position and the run speed of the sheet conveying belt 60. This feedback control system comprises a position detecting circuit 77 that converts to a position signal the signal from the sensor 12, which reads the scale 70 bearing microscopic calibration provided on the inner surface of the sheet conveying belt 60, and a speed detecting circuit 78 that converts to a speed signal the signal from the sensor 12. The feedback control system forms minor loops that negative-feedbacks each signal, each position signal, and each speed signal.

In the feedback control system shown in FIG. 12, the structure of a sheet conveying unit, which is to be controlled, is divided into four blocks, namely, a driving motor unit 75, a mechanical unit 76, the sheet conveying belt 60, and the scale 70, and represents a model connected according to the substitution principles of the feedback control. The driving motor unit 75 comprises a not shown driving motor and an axis of rotation, etc., and rotates uniformly. The mechanical unit 76 is fabricated from two support rollers and is coupled with the sheet conveying belt because of the friction, and transmits the rotation to the driving motor unit 75.

The sheet conveying belt 60 and the scale 70 constitute one unit and the unit rotates according to the friction with the mechanical unit 76. Consequently, in the rotation movement of the sheet conveying belt 60 and the scale 70, the fluctuation in the speed of the driving motor as well as the rolling of the two support rollers because of the friction is propagated to the sheet conveying belt 60 and the scale 70 bearing microscopic calibration. Consequently, the sensor 12 can precisely detect the amount of movement (rotation position) of the sheet conveying belt 60. In other words, the position signals and the speed signals, which are obtained by calculating from the output of the sensor 12, are the precise result of the detection directly carried out for the sheet conveying belt 60. As the precise detection result of the amount of movement (rotation position) of the sheet conveying belt 60 can be obtained, the correction in the write timing can also be precisely carried out.

A position control circuit 71 calculates the difference between the precise and minute position signals from the position detecting circuit 77 and a position instruction (target position), and can precisely calculate and output a speed instruction (target speed). A speed control circuit 72 calculates the difference between the precise speed instruction (target speed) from the position control circuit 71 and the speed signals from the speed detecting circuit 78. The speed control circuit 72 then calculates the precise electrical energy supplied to the not shown driving motor and outputs it to an electric power converting circuit 73, and controls the driving motor. Consequently, it is possible to precisely and minutely feedback-control the amount of movement (rotation position) of the sheet conveying belt 60.

The feedback control system shown in FIG. 12 can be fabricated from an analog circuit or a digital circuit. Electronic components that are easily available in the market and carry out high speed, high precision, and highly reliable operations can be used as the position detecting circuit 77, the speed detecting circuit 78, the position control circuit 71, and the speed control circuit 72. For instance, an operational amplifier, a counter, an analog to digital converter, a digital to analog converter, etc., can be used in the structure. The electric power converting circuit 73 can be fabricated from commonly used transistors such a bipolar transistor (silicon, etc.), a field effect transistor, etc.

As described above, by switching over to controlling the drive timing of the sheet conveying belt 60, the start timing of the image formation can also be controlled. In this case, from the result of the movement speed detection of the sheet conveying belt 60 and the distance between the transfer nip of each color Ny, Nm, Nc, and Nb, the time required for the transfer position of the sheet S to pass through the transfer nip for each color Ny, Nm, Nc, and Nb is calculated. By postponing the start time of the operation by the amount of this calculated time, the ends of the image can be matched more precisely than in the case when the operation is carried out with a fixed start time interval of the operation.

Even if the sheet conveying belt 60 is precisely driven, there may be fluctuations in the coefficient of surface friction or the hardness of the sheet itself and the sheet may shift in an unexpected manner. Hence, it is desirable to avoid as far as possible the shift in the transfer position caused due to the fluctuation in the movement speed of the sheet conveying belt 60.

In the color copying machine according to the first and second embodiments of the present invention, the scale 70 used for speed detection and the sensors 12A, 12B, and 12*c* are placed on the inner surface of the intermediate transfer belt 10 or the sheet conveying belt 60. Consequently, there is less interference on the layout with the other parts such as the photosensitive drum or the developing device, etc., and the whole apparatus can be miniaturized. Further, the defects in detection due to the toner marks can be prevented.

In the first and second embodiments, a tandem type apparatus was used that included plural photosensitive drums. However, the apparatus suitable for the present invention is not confined only to such a tandem type apparatus. For instance, a single-drum type printer of an indirect transfer system may also be used. The single-drum type printer is a color printer that, after transferring a composite color image formed by sequential developing on one of the photosensitive drum 40 to the intermediate transfer belt 10 that is rotated by plural support rollers, batch-transfers the composite color image on the intermediate transfer belt on to the sheet S. In this printer, the scale 70 according to the present invention is provided on the inside periphery and can be detected by the sensor 12. The same results as those of the first and second embodiments can be obtained with such a structure.

According to the first embodiment of the present invention, the Young's modulus of the intermediate transfer belt 10 is set higher than the Young's modulus of the scale 70. Consequently, the edges of the belt do not bend inwards and the angle of the scale 70 does not tilt with respect to the sensor 12. As a result, a more precise speed detection of the belt can be carried out.

In another variation of the first embodiment of the present invention, the Young's modulus of the intermediate transfer belt 10 is set higher than the Young's modulus of the protection seal. Consequently, the edges of the belt do not bend inwards and a more precise speed detection of the belt can be carried out.

According to the first embodiment of the present invention, the Young's modulus of the intermediate transfer belt 10 is set such that the color shift on the actual image is not greater than 0.03 [mm]. Consequently, the color shift can usually be controlled to an extent such that it is not visually recognizable.

According to the first embodiment of the present invention, the driving motor used as the driving source of the intermediate transfer belt 10 is controlled based on the detection result of the sensors 12A, 12B, and 12C. Consequently, the speed control of the intermediate transfer belt 10 is carried out and the belt speed at each transfer position can be maintained constant. Hence, a better color image that has no image color shift can be formed on the intermediate transfer belt 10.

According to the second embodiment of the present invention, the start timing of the operation is controlled based on the result of the movement speed detection of the sheet conveying belt 60 and thus the front edge location of the four-color image copied on to the sheet is obtained. Hence, a better color image that has no image color shift can be formed on the sheet.

In the variation according to the first embodiment of the present invention, the Young's modulus of the intermediate transfer belt 10 is set higher than the Young's modulus of the stopper 73. Consequently, the edges of the belt do not bend inwards and a more precise speed detection of the belt can be carried out. As the stopper 73 hits the side surfaces of the support rollers 14, 15, and 16, and does not collide with the corners of the rollers or climb on to the side surfaces of the rollers, malfunctioning in the driving of the belt can also be prevented.

According to the first embodiment of the present invention, the present invention is applied to the intermediate transfer belt 10 that temporarily bears the image copied from the photosensitive drum. Consequently, the color shift of the composite color image formed on the intermediate transfer belt 10 can be prevented and a better color image can be obtained.

According to the second embodiment of the present invention, the present invention is applied to the sheet conveying belt 60 carries the sheet on which the image is copied. Consequently, there is no position shift, which is caused due to the fluctuation in the speed of the sheet conveying belt 60, in the image transfer position of the sheet carried on the sheet conveying belt 60. Consequently, if the sheet supported on the sheet conveying belt 60 is carried at the same speed as that of the belt, a better image with a precise transfer position and no color shift can be obtained.

In the image forming apparatus according to claims 1 to 9, there is no deformation of the rotating belt caused due to the difference in the stretching of the rotating belt in the portion where the affixed material is present and in the portion where the affixed material is absent. Consequently, in an image forming apparatus in which a rotating belt is used where the affixed material is attached to a portion in the width direction, the unexpected deformation caused due to the affixed material of the rotating belt can be effectively prevented.

The present document incorporates by reference the entire contents of Japanese priority documents, 2002-271704 filed in Japan on Sep. 18, 2002.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. A belt comprising:

an arrangement that is attached to a portion of the belt, wherein the belt has a Young's modulus and the arrangement has a Young's modulus that is smaller than the Young's modulus of the belt, and the arrangement is a protection seal that protects an edge of the belt from wearing, said protection seal having a Young's modulus in the range of 300 megapascals to 800 megapascals.

2. A belt comprising:

an arrangement that is attached to a portion of the belt, wherein the belt has a Young's modulus and the arrangement has a Young's modulus that is smaller than the Young's modulus of the belt, and the Young's modulus of the belt satisfies a relation:

$$T/E \times L \times \alpha \leqq 0.03 \text{ [millimeter]}$$

where, T is a tension applied to the belt in [N/mm2], E is the Young's modulus of the belt in [megapascals], L is a maximum image length in [millimeter], and $\alpha$ is a percentage fluctuation in the Young's modulus.

3. A belt comprising:

an arrangement that is attached to a portion of the belt, wherein the belt has a Young's modulus and the arrangement has a Young's modulus that is smaller than the Young's modulus of the belt, and the arrangement is a stopper, which prevents the belt from biasing toward an edge side at the time of being driven, wherein the stopper has a Young's modulus in a range of 2 megapascals to 10 megapascals, and the Young's modulus of the belt is in a range of 3000 megapascals to 7000 megapascals.

4. An image forming apparatus comprising:

means for forming an image;

means for driving a rotating belt for conveying a medium on which an image is directly transferred, the rotating belt having a Young's modulus; and an arrangement that is attached to a portion-along the rotating belt, the arrangement having a Young's modulus that is smaller than the Young's modulus of the rotating belt, wherein the arrangement is a protection seal that protects an edge of the rotating belt from wearing, said protection seal having a Young's modulus in the range of 300 megapascals to 800 megapascals.

5. An image forming apparatus comprising:

means for forming an image;

means for driving a rotating belt for conveying a medium on which an image is directly transferred, the rotating belt having a Young's modulus; and an arrangement that is attached to a portion-along the rotating belt, the arrangement having a Young's modulus that is smaller than the Young's modulus of the rotating belt, wherein the Young's modulus of the rotating belt satisfies a relation:

$$T/E \times L \times \alpha \leqq 0.03 \text{ [millimeter]}$$

where, T is a tension applied to the rotating belt in [N/mm2], E is the Young's modulus of the rotating belt in [megapascals], L is a maximum image length in [millimeter], and $\alpha$ is a percentage fluctuation in the Young's modulus.

6. An image forming apparatus comprising:

means for forming an image;

means for driving a rotating belt for conveying a medium on which an image is directly transferred, the rotating belt having a Young's modulus; and an arrangement that is attached to a portion-along the rotating belt, the arrangement having a Young's modulus that is smaller than the Young's modulus of the rotating belt, wherein the arrangement is a stopper, which prevents the rotating belt from biasing toward an edge side at the time of being driven, the stopper has a Young's modulus in a range of 2 megapascals to 10 megapascals, and the Young's modulus of the belt is in a range of 3000 megapascals to 7000 megapascals.

* * * * *